US009534520B2

(12) United States Patent
Mordukhovich

(10) Patent No.: US 9,534,520 B2
(45) Date of Patent: Jan. 3, 2017

(54) TEMPERATURE-CONTROLLED SEGREGATION OF HOT AND COLD OIL IN A SUMP OF AN INTERNAL COMBUSTION ENGINE

(75) Inventor: Gregory Mordukhovich, Bloomfield Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 441 days.

(21) Appl. No.: 13/479,373

(22) Filed: May 24, 2012

(65) Prior Publication Data

US 2013/0312696 A1 Nov. 28, 2013

(51) Int. Cl.

| | |
|---|---|
| ***F01M 5/00*** | (2006.01) |
| ***F01M 11/00*** | (2006.01) |
| *F01M 5/02* | (2006.01) |

(52) U.S. Cl.

CPC .... *F01M 11/0004* (2013.01); *F01M 2005/023* (2013.01); *F01M 2011/0045* (2013.01)

(58) Field of Classification Search

USPC .... 123/195 R, 195 C, 196 AB; 184/6.13, 68, 184/80, 88.1, 104.1

See application file for complete search history.

(56) References Cited

U.S. PATENT DOCUMENTS

| | | | | |
|---|---|---|---|---|
| 4,533,042 | A * | 8/1985 | Pollacco | 206/223 |
| 4,683,851 | A * | 8/1987 | Henneberry | 123/196 S |
| 5,301,642 | A * | 4/1994 | Matsushiro et al. | 123/196 AB |
| 6,729,269 | B2 * | 5/2004 | Ott et al. | 123/41.31 |
| 2005/0056491 | A1 * | 3/2005 | Griesmeier et al. | 184/6.21 |
| 2008/0066982 | A1 * | 3/2008 | Kobayashi et al. | 180/69.1 |
| 2009/0145695 | A1 * | 6/2009 | Hiramatsu | 184/106 |
| 2011/0011367 | A1 | 1/2011 | Staley et al. | |

* cited by examiner

*Primary Examiner* — Hung Q Nguyen
*Assistant Examiner* — Ruben Picon-Feliciano
(74) *Attorney, Agent, or Firm* — Reising Ethington P.C.

(57) ABSTRACT

The volume of lubricating oil stored in the sump of an internal combustion engine for a vehicle is in significant excess of the volume of oil circulating through the engine at any one time. The circulating oil, drawn from the sump, may be rapidly heated during its passage through the engine, but the excess volume remaining in the sump dilutes and cools the circulating oil as it returns to the sump. By separating the oil volume into a portion which is circulated through the engine and a second portion which has only limited opportunity to mix with and cool the circulating oil the circulating oil may attain its operating temperature more rapidly. Once the stored volume of oil in the engine has also reached its operating temperature the circulating oil and stored oil may be recombined.

13 Claims, 5 Drawing Sheets

TEMPERATURE-CONTROLLED SEGREGATION OF HOT AND COLD OIL IN A SUMP OF AN INTERNAL COMBUSTION ENGINE

TECHNICAL FIELD

This invention pertains to enhancing the efficiency of an internal combustion engine by rapid heating of circulating engine oil though preferential circulation of previously-heated oil. Mixing of the previously-heated oil and cold oil in the engine sump is discouraged through the use of a selectively-permeable screen which only promotes mixing when the sump oil attains a preselected viscosity.

BACKGROUND OF THE INVENTION

The text of this background section is to prepare the reader for understanding practices described in this disclosure. The text is not presented with a consideration of whether it discloses prior art.

Multi-cylinder, reciprocating piston, internal combustion engines for automotive vehicles typically contain an oil circulation system for lubrication of valves, cylinder walls, pistons, connecting rods, cranking mechanisms, and the like. Generally, a predetermined quantity of lubricating oil (e.g., four to six quarts) is stored in bucket-like sump container attached to the engine below the cranking mechanism. When the engine is operating, an oil pumping mechanism, often driven off the engine, draws lubrication oil from the sump container and pumps it upwardly over all moving engine parts. The oil is drawn through an oil pick-up or inlet tube positioned below the surface of the sump oil. The oil flows in an oil circulation path, as intended and provided, over engine parts requiring lubrication. As it completes its flow, the oil drains downwardly back into the sump container. Typically, less than half of the stored volume of oil is in circulation at any moment of engine operation. In this way an adequate supply of oil is assured despite irregular motion of the vehicle, or leakage of the oil or burning of some of the oil as it is exposed on cylinder walls.

The oil is heated during engine operation, often to temperatures of about 90° C. to about 110° C. and at this temperature the oil has a viscosity and flow properties well suited for lubrication of engine surfaces. But when engine operation has ceased, the stored and now quiescent oil is cooled to the ambient temperature in which the vehicle is situated. Since this temperature may be well less than about 30° C., temperature-dependent properties of the oil are often less than desired for engine operation. So the oil may be relatively cold and viscous as its circulation is commenced immediately following an engine cold start. Sometimes vehicles intended for cold climates have special oil heaters located in the sump container for keeping the oil at a desired temperature between intermittent usages of the engine. Most vehicles do not have such an oil heater. But there is a need to reheat the circulating oil for better engine operation and less engine wear. A difficulty is that the total volume of oil is considerably larger than the amount being circulated and heated by the engine at any operating moment.

SUMMARY OF THE INVENTION

In accordance with practices of this invention, the oil storage volume in the sump container is divided into two volumes using a separator which may be a thin metal sheet with many small holes or small mesh metal screen member.

The size of the small holes in the sheet or the mesh openings in the screen are determined to impede flow-through by a cold viscous oil but to permit passage of the same oil heated for engine operation.

The sheet or screen separator member is shaped, located, and fixed in the sump container to catch and contain circulated, returning engine oil from a started and operating engine and direct it to an oil pick-up in the sump for continued circulation. The cold oil-retaining separator member is also shaped and located to enclose a volume of oil from the total stored oil volume, the enclosed volume lying between the separator and the sump walls and bottom. The circulating oil is drawn from and returned to the free volume defined by the separator. The remaining portion of the oil in the sump container volume is outside the circulated oil volume and contained within the screen member enclosed volume. For example, in a five or six quart oil capacity engine, the circulating volume of oil within the separator defined space may be about one and one-half quarts, or about 25 to 30% of the total oil volume, with the remaining cold oil contained within the enclosed volume.

Thus, immediately following an engine cold-start, a selected portion of the oil from the overall sump container volume is pumped upwardly into the oil circulation paths through the engine, and this volume of circulating oil is drained back into the free storage volume defined within the screen or sheet member. This smaller portion of oil is determined for adequate lubrication of the parts of the engine. But this smaller portion is also more rapidly heated by engine operation from the stored oil's ambient temperature to its preferred operation temperature, somewhat above 90° C.

So, during a period of a few minutes following an engine cold start, the total oil volume within the sump container has been divided by the screen or sheet member into two portions. The smaller free portion contained within an upper and central volume (with respect to the return drain path of the circulated oil) is being heated as it is circulated through the engine. The larger oil volume contained within the sump vessel, but temporarily and partially excluded from circulation by the separator member, is cooler. But the separation of the warming circulating oil from the excluded outer oil volume in the sump container is temporary.

The screen or shell member is formed of a metal or other suitable thermally conductive material so that heat is transferred through the member from the engine heated oil to the temporarily non-circulated oil. Further, the small screen or sheet openings of the separator become less resistant to oil flow as the oil is heated. The screen mesh opening or sheet perforations are sized to permit easy passage of heated oil (e.g., at 60° C. or higher) while slowing and impeding passage of colder oil through the perforations. It is in this way that the perforated sheet or screen member temporarily excludes much of the cold oil from the enclosed volume defined by the shell member. But some circulated and warming oil can enter the enclosed volume as it is returned to the circulating oil volume. As engine operation continues, oil flow through the perforations in the sheet member permits heating of the total oil volume, and the temporarily separated oil volumes are, in effect, recombined by easy flow of heated oil through the perforations in the separator shell member.

Thus, the openings in the screen or sheet are sized to permit a slow flow of relatively cold oil and to permit easy flow of hot oil. As described the function of the screen or perforated sheet is simply to permit the recirculation of a loosely confined portion of the total oil volume to hasten heating of the oil following an engine cold start. But the goal is to continually heat and circulate all of the stored oil during continued engine operation so that the screen or sheet presents only a modest resistance to flow of heated oil. The sheet serves its task mainly following an engine cold-start and reduces the time required to heat some oil to its effective lubricating temperature. Thereafter, during continued engine operation, the rest of the stored oil is heated. But the duration of the cold start period with less effective lubrication is reduced.

BRIEF DESCRIPTION OF THE DRAWINGS

FIG. 5A shows a perspective view of a portion of a sheet separator incorporating a plurality of openings; FIG. 5B shows a woven mesh separator. Both separators are suited to prevent or restricting passage of lubricating oil at a temperature of less than about 6020 C. while allowing passage of lubricating oil at temperatures of greater than 60° C.

DESCRIPTION OF PREFERRED EMBODIMENTS

Lubricating oils in internal combustion engines, in common with most liquids, become less viscous as their temperature increases. Although such oils commonly include, as part of a more extensive additive package, a viscosity modifier, this will only reduce, not eliminate, the extent of the viscosity reduction. Hence an oil formulated to develop an appropriate viscosity for effective lubrication at normal engine operating temperatures of 90-110° C. or so will exhibit a higher viscosity as the engine, and its lubricating oil, is warming to its steady-state operating temperature after a cold start. This higher viscosity results in increased friction and reduced vehicle fuel economy during the 800-1200 seconds or so required for the engine to reach its operating temperature. It is an object of this invention to mitigate the negative impact of cold starts on vehicle fuel economy.

Figure 1:
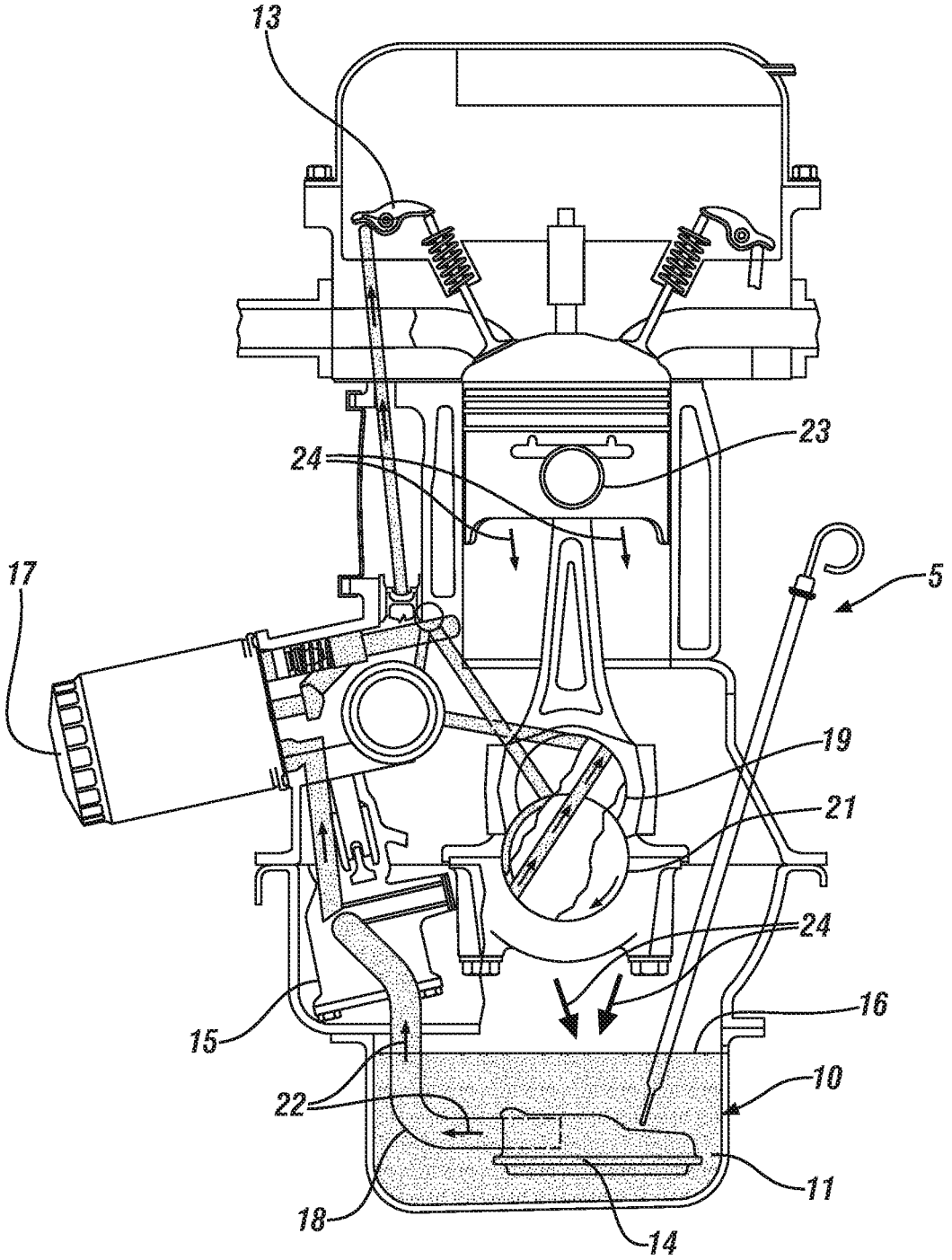
FIG. 1 shows, in cross-section, an internal combustion engine schematically illustrating the circulating path followed by the lubricating oil.

FIG. 1 shows, in schematic cross-section, an engine 5 suitable for use in a motor vehicle. Oil 11 is stored in sump 10 for delivery to the engine. Oil is withdrawn from sump 10 at oil pick-up 14 under the urging of oil pump 15 and flows as flow 22 through tube 18 to filter 17. After passing through filter 17 the oil is distributed under pressure by an appropriate arrangement of channels and orifices to all regions of the engine requiring lubrication. These lubricated elements include rocker arm 13 and the valve system located at the topmost location of the engine as well as bearings 19, 21 and 23. After performing its lubrication function the oil returns to sump 10 as droplets 24 under the influence of gravity.

Figure 2:
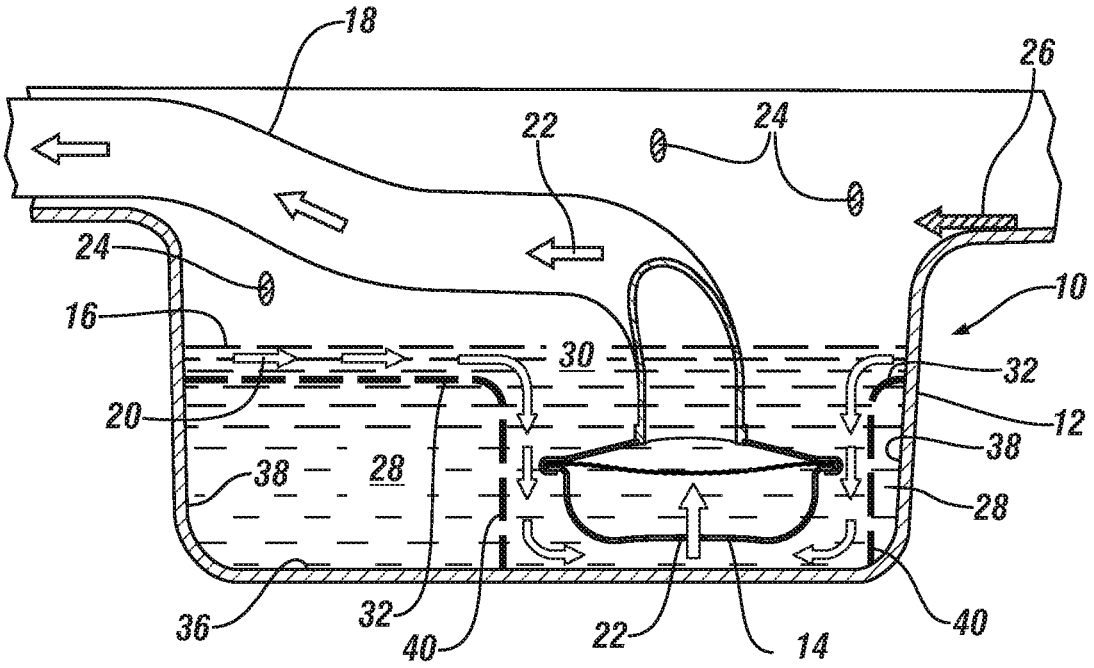
FIG. 2 shows, in sectional view, a schematic representation of oil flow in a portion of a schematic, but representative engine oil sump with an associated oil intake. The oil in the sump is partitioned into two volumes by a temperature-sensitive separator, and the oil flow shown is representative of the initial oil flow expected during practice of the invention immediately after a cold engine start when the oil is at a temperature of less than about 60° C.

An exemplary embodiment of the invention is shown in FIG. 2 which is a schematic sectional view of a portion of a sump 10 of an internal combustion engine like that shown in FIG. 1, showing the oil pick-up 14 contained within oil pan 12. Oil fills the oil pan 12 to a predetermined level 16 and oil entering oil pick-up 14 is conveyed to the engine through tube 18 by an oil pump (not shown). Oil flow within the sump is shown by arrows 20 and the aggregated oil flow within tube 18 by arrows 22. Heated oil which has previously passed through the engine and is returning, under the action of gravity to sump 10 is shown as droplets 24. Individual droplets may also deposit on some of the unseen sump surfaces and consolidate into flow 26 directed into the oil pan.

In an embodiment the oil in oil pan 12 is sequestered into two layers 28 and 30 by separator 32. Separator 32 is a generally planar and horizontally mounted below the oil surface indicated by oil level 16. Separator 32 has an opening surrounding oil pick-up 14 allowing upper oil layer 30 free access to pick-up 14. The opening is bounded by a downwardly extending flange 40 extending to inner bottom surface 36 of oil pan 12. It is intended that separator 32 seal against the surfaces of oil pan 12 wherever the perimeter edges or flange edges of the separator contact the oil pan to prevent passage of oil from one volume to the other at the oil pan interior surfaces. Lower oil layer 28 is contained between the inner surface 34 of separator 32 and the inner bottom surface 36 and the sidewalls 38 of oil pan 12. It will be appreciated that the respective volumes of upper oil layer 30 and lower oil layer 28 may not be readily estimated from this figure since the lateral extent of the oil pan, shown in the section, is much less than its longitudinal extent. Thus the volume of oil accessible to oil pick-up 14 is disproportionately emphasized in lateral section.

Separator 32 comprises a plurality of openings in a thin sheet or a fine mesh screen. Commonly such a sheet would be metal, but any material which may be fabricated as a thin sheet and not react with hot oil or any of the fuel or water-based or other impurities in the oil pan would be suitable. However it is preferred that the separator possess good thermal conductivity to promote heat flow from heated oil on one side of the separator to colder oil on the other side. Thus metallic separators may be commonly used. Such separators may be fabricated of those metals and alloys, optionally coated, currently in use for oil pans since these have clearly demonstrated durability in an engine oil environment.

Figure 5A:
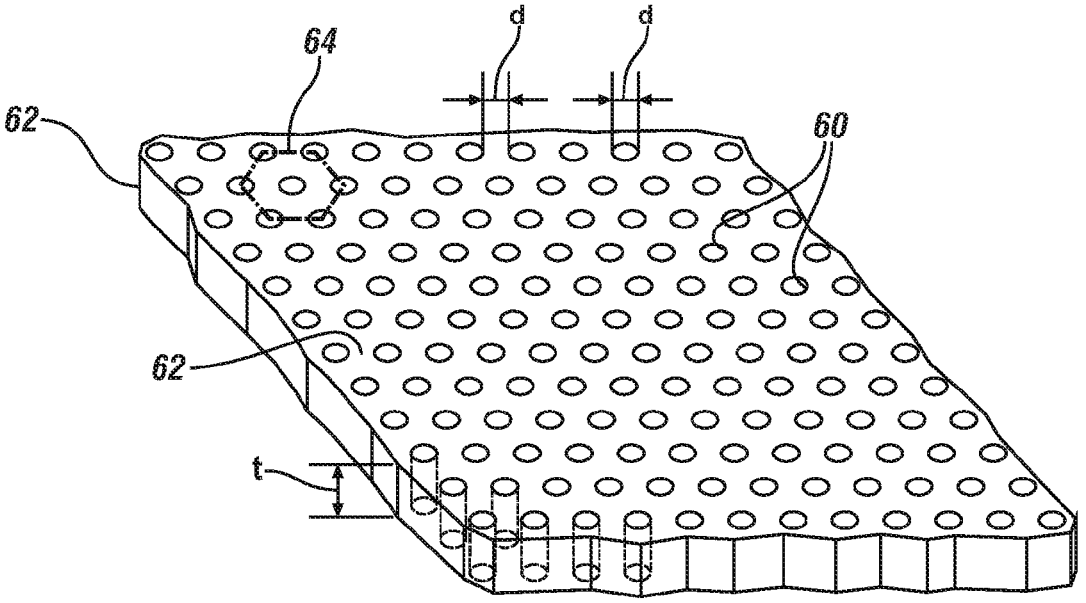
FIGS. 5A and 5B show two exemplary separators.
Figure 5B:
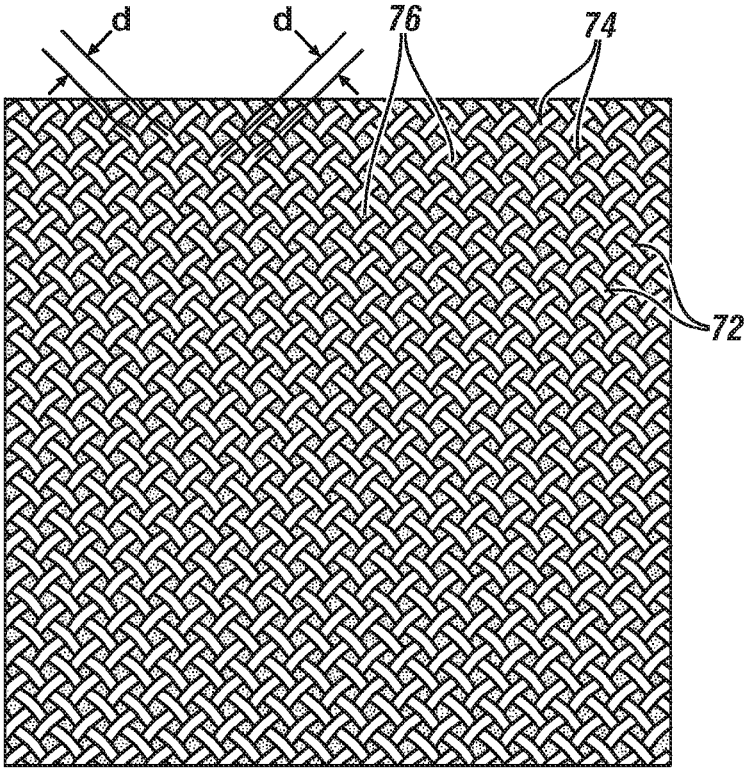

An exemplary arrangement of orifices in a sheet is shown in FIG. 5A. Commonly such orifices may be circular in plan view as shown, but alternate geometries, such as ovals, slits or regular or irregular polygons may be employed provided at least one dimension of the orifice does not exceed a characteristic dimension. The characteristic dimension is selected so that the orifices severely impede the flow of higher viscosity oil, that is oil at a temperature of about 60° C. or less, but enable flow of the same oil at a temperature of greater than about 60° C. or so when it is in a lower viscosity state. The particular characteristic dimension will vary with the particular lubricating oil but will generally range from about 100-300 micrometers. An exemplary polygonal opening will generally obtain in woven wire mesh separators such as that shown in FIG. 5B in which openings 76 of dimension 'd' are defined by the spacings between arrays of interwoven arrays of orthogonal wires 72, 74. Opening shapes other than the generally square openings shown in FIG. 5B may be developed under more complex weaves.

Referring to FIG. 5A it will be noted that orifices 60, only some of which are shown extending through sheet 62 for clarity, are arranged in a hexagonal arrangement highlighted at 64. This particular arrangement enables close packing but it is intended to be illustrative rather than limiting and other arrangements of the orifices may be used without limitation. The orifices are shown as spaced apart to avoid unduly weakening supporting sheet 62. As shown the orifices may be spaced apart by a distance 'd' substantially equal to the diameter 'd' of the orifices but other suitable spacings may also be used.

The area density of orifices should be sufficient to enable an oil flow rate substantially equal to or greater than the oil flow rate through the engine. As an example, an array of orifices 200 micrometers in diameter arranged as shown in FIG. 5A on a separator with an area of 100 square inches or so, may pass up to about 30 gallons per minute under a 1 inch head. This flow rate is sufficient for a high performance V8 engine for a sports car. The more open weave mesh of FIG. 5B enables yet greater flow.

The flow characteristics of the interface may be enhanced by shaping the exit geometry of the orifice. The calculated results referred to above were representative of the orifice of FIG. 6A, that is an orifice in a very thin sheet of thickness (indicated as 't' in FIG. 5A) of less than one quarter of the orifice diameter. For the 200 micrometer orifice discussed above this would imply that the sheet be a foil of 50 micrometers or so. Such a foil may require that it be mounted on a frame or similar support structure to support the loads which might be applied to it, for example by sloshing oil on cornering or abruptly stopping the vehicle. It may be noted that use of this thin foil exacts a flow performance penalty of about 25% over the use of the thicker sheet shown in FIG. 6B.

Figures 6A, 6B, 6C:
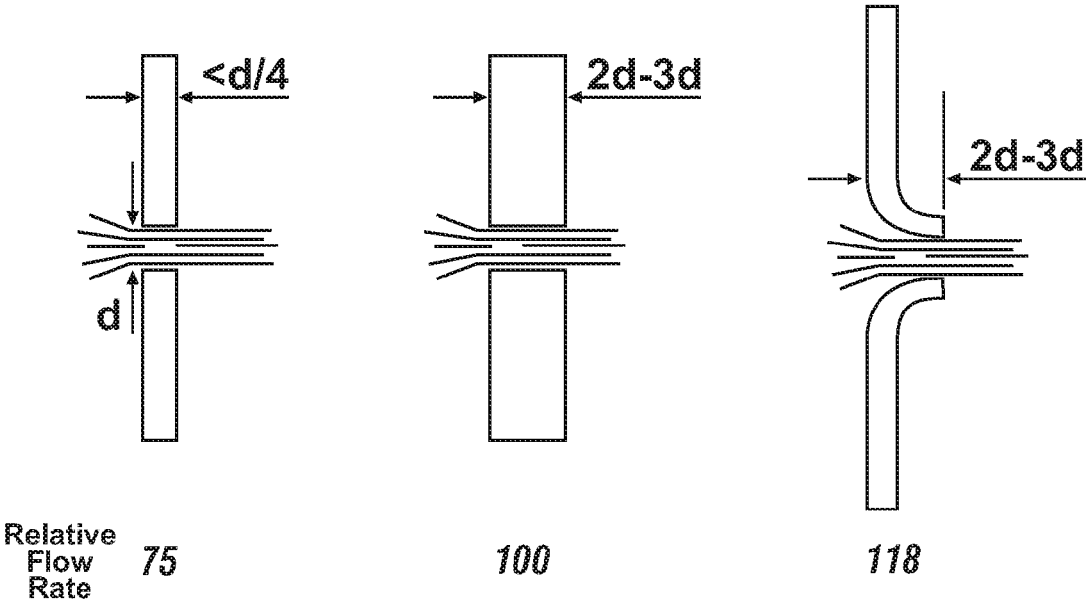
FIGS. 6A-C show, in cross-section, several orifice configurations and indicate the difference in flow capacity of these orifice configurations.

Increasing the sheet thickness to between two and three times the orifice dimension as shown in FIG. 6B enables, for a two hundred micron orifice, a sheet thickness of between 0.2 and 0.3 millimeters enabling the sheet to be self-supporting eliminating and eliminating any need for a frame or support structure. As noted, the thicker sheet enables greater fluid flow than the thinner sheet. While such theory is not relied on it appears that the extended channel length may result in a more organized flow pattern and induce less backpressure.

Yet further modification of the orifice, while maintaining the same exit diameter, is shown in FIG. 6C. Again the orifice extends to between two and three times the orifice dimension, but, in addition, the orifice inlet is tapered, resulting in a smoother flow transition and a further increase in flow by about 18% over the straight-sided orifice of FIG. 6B. For ease of manufacture, preferably the tapered geometry of FIG. 6C is developed on a foil, as in FIG. 6A, again raising the issues of the mechanical stability of the foil under applied loads. Also, as will become apparent in consideration of the oil flow paths the direction in which the flared section extends from the sheet may need to be modified consistent with the anticipated oil flow paths.

The straight-sided orifices of FIGS. 6A and 6B may be made by drilling using conventional microdrills or by spark machining or laser drilling. The orifice geometry of FIG. 6C may be developed by piercing and flaring using a tapered point cylindrical punch which will, when the point penetrates the sheet, flare the surrounding material provided the sheet's ductility is sufficient to resist flange cracking The influence of separator 32 on the oil flow paths in the oil pan 12 may be appreciated by consideration of FIGS. 2, 3 and 4 which are illustrative of the evolution in oil flow path as the engine, after a cold start, progressively heats up to its operating temperature.

As illustrated in FIG. 2, immediately after cold start up, the oil of lower oil layer 28, at a temperature of less that 60° C. is initially prevented from accessing oil pick-up 14 by separator 32. Oil pick-up 14 therefore draws oil substantially exclusively from upper layer oil 30 conveying it to the engine (not shown) as aggregated flow 22 under the urging of an oil pump (not shown). The oil, now heated after its passage though the engine, returns to the sump as droplets 24 and consolidated flow 26. The oil of upper oil layer 30, though warmed by the engine-heated returning oil remains below 60° C. and so substantially cannot pass through separator 32. Oil in upper oil layer 30 therefore flows parallel to the surface of separator 32 as indicated by arrows 20 and returns to oil pick-up 14 without significantly mixing with the oil of lower oil layer 28. The individual oil flows 20, on converging at the oil pick-up 14 are aggregated into oil flow 22 and conveyed into engine.

Figure 3:
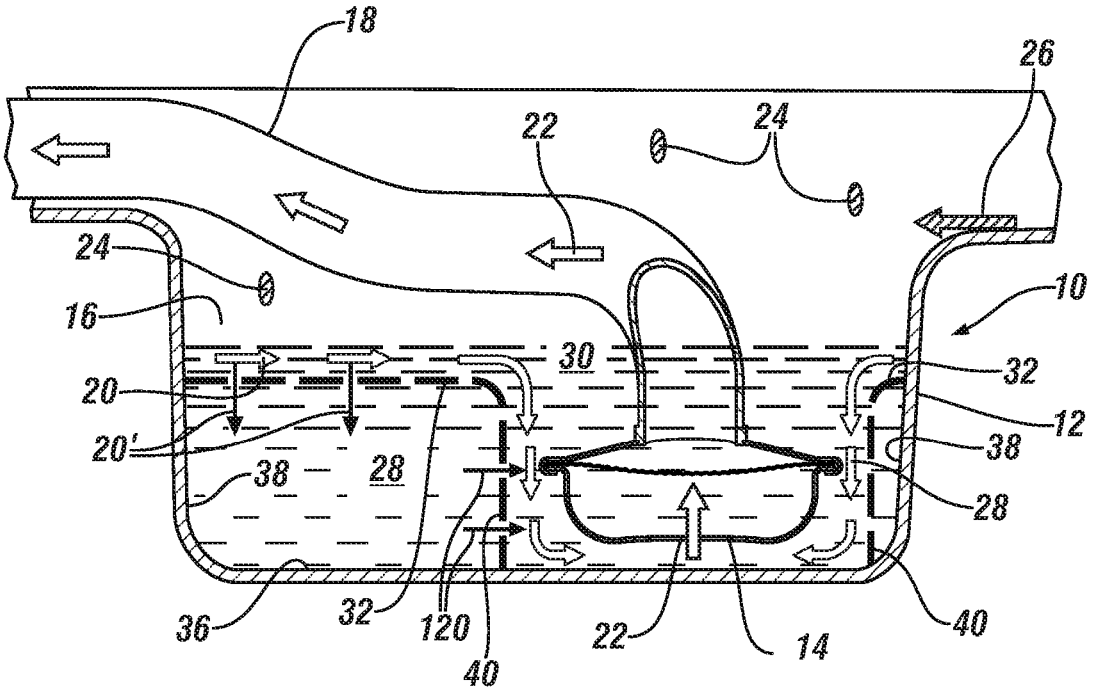
FIG. 3 shows a representation of the oil flow in the engine oil sump portion of FIG. 2 after some period of engine operation during which one of the oil volumes has attained a temperature of greater than 60° C. while the bulk of the second oil volume remains at a temperature of below about 60° C.

FIG. 3 is illustrative of the oil flow at a later stage in the engine warm-up. The oil of the upper oil layer 30 upper layer continually heated by returning heated returning oil droplets 24 and returning consolidated oil flow 26 achieves a temperature of about 60° C. or so at which it may pass through separator 32. However, because of its lower density than the cooler oil of lower oil layer 28, the preponderance of flow is still parallel to separator 32 as indicated by arrows 20. But passage of heated oil flow 20 serves to warm separator 32 and elevate the temperature of some volume of the oil of lower oil layer 30 in contact with inner surface 34 of the separator. When the temperature of the volume of oil in contact with inner surface 34 is sufficient to enable flow through separator 32 some volume of oil from lower oil layer 28 may pass though separator 32 as flow 120 to merge and mingle with flow 20 as it merges into aggregated flow 22. The volume of oil corresponding to flow 120 may be replaced by leakage of some oil from the upper oil layer into lower oil volume 28 via flow 20'. Continued engine operation will further elevate the temperature of the oil of upper oil layer 30 and promote further heating of, and flow into and out of lower oil volume 28.

Figure 4:
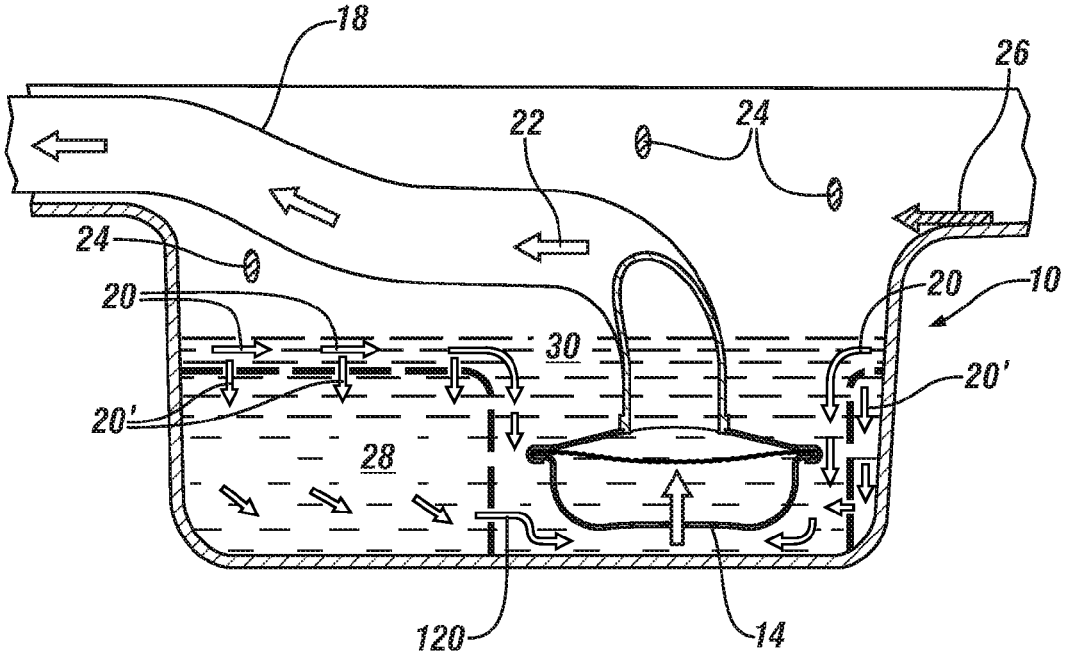
FIG. 4 shows a representation of the oil flow in the engine oil sump portion of FIGS. 2 and 3 after both oil volumes have attained a temperature of greater than about 60° C.

When all oil, in both the upper and lower oil layers, achieves a temperature above about 60° C. or so, rendering separator 32 fully permeable to all of the oil, the flow will be as shown in FIG. 4. Flow 20 in upper oil layer 30 will continue but the volume of flow 20' from the upper oil layer 30 to lower oil layer 28 and the volume of flow 120 from the lower oil layer to the upper oil layer will both increase, promoting full circulation and engaging all the oil in the sump.

Figure 7:
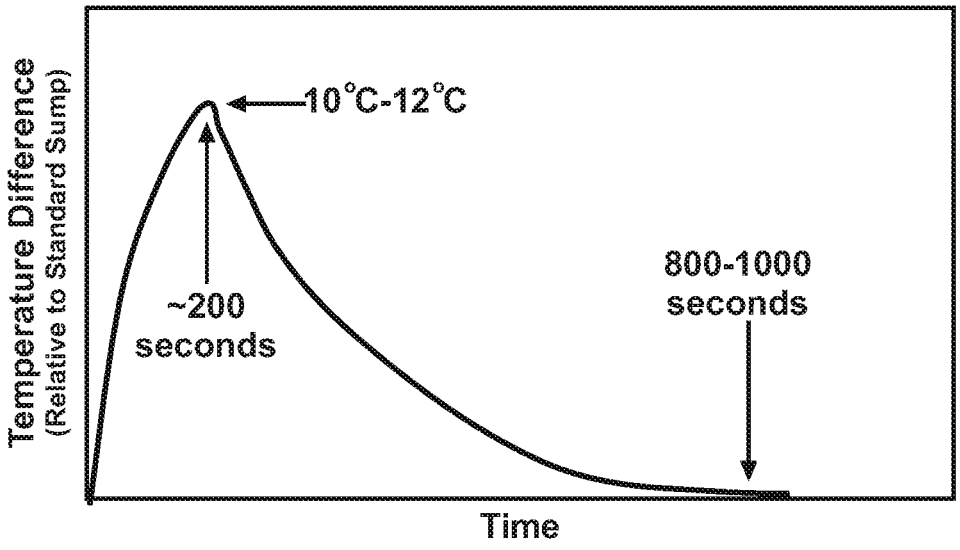
FIG. 7 shows a representative curve showing the difference between the circulating oil temperature in an engine adapted for practice of the invention and a conventional engine with a conventional sump after a cold start. The result illustrates the increase in oil temperature and hence the reduction in viscosity and associated fuel economy enhancement obtainable through practice of the invention.

The effectiveness of this approach is shown in FIG. 7, a representative curve illustrating the difference in oil temperature with time after cold start resulting from practice of this invention. The curve shows the difference in circulating oil temperature recorded for an engine with an oil pan containing a separator as described and an engine with a conventional oil pan without a separator. In both cases the oil attains its normal operating temperature about 800-1000 seconds after cold start, leading to a temperature differential of substantially zero. But the engine with the separator enables a rise in circulating oil temperature during the warmup period. The temperature difference rise develops immediately after start-up and increases rapidly to a maximum value of about 10-12° C. at about 200 seconds or so after engine start, before starting to decline as the circulating oil in both engines progresses to its steady-state normal operating temperature after about 800-1000 seconds or so.

The relative partitioning of the total oil volume may depend on the specifics of a particular engine but the volume should be informed by the need to not starve the engine of oil during warm-up, particularly during the first 10-20 seconds after start-up. During this initial period the gravitational return flow of the still-cool, viscous oil to the sump may be delayed resulting in an initial circulating oil volume which is greater than would occur at steady-state.

The volume of oil participating in engine lubrication should also be informed by its ability to temporarily accept and hold contaminants, such as water and unburned fuel, from the combustion chamber, which blow by the piston rings. Such contaminants may exist as vapors in a hot engine and be eliminated by the positive crankcase ventilation system of the engine. In cold engine and during warm-up they will condense and temporarily dissolve and be dispersed in the cold oil. Thus another constraint on the oil volume partition effected by the separator is that the circulating oil volume be sufficient to accommodate the oil contaminants produced on cold start without prejudicing its lubricating properties. All of these requirements may be met if the sump is so partitioned as to enable an initial circulating oil flow of at least one and one-half quarts. This will correspond to about 25 to 30% of the total oil volume in a conventional engine whose normal oil requirement is for five or six quarts.

While preferred embodiments of the invention have been described as illustrations, these illustrations are not intended to limit the scope of the invention.

The invention claimed is:

1. A method of heating a volume of oil contained in a sump of an internal combustion engine from a reduced initial temperature to its operating temperature, the sump having side-walls and a bottom, the engine having an oil circulation system suitable for conveying some portion of the oil volume through the engine and thereby heating the oil; the method comprising:

employing a metal porous separator located in the sump, the porous separator having generally vertical upstanding walls extending from the sump bottom and having outwardly extending upper walls extending from the upstanding walls to the sump sidewalls, the separator serving to partition the sump volume into a first sump volume at least partially contained within the upstanding walls of the separator and a second sump volume contained between the upstanding and upper walls of the separator and the side-walls of the sump;

the porous separator comprising a wire mesh or perforated sheet, the separator being less than about a millimeter in thickness, wherein the separator comprises a plurality of openings with a characteristic dimension of between about 100 and 300 micrometers and has a thickness of between 2 and 3 times the characteristic dimension, the separator partitioning the oil volume into two portions, a circulating portion contained within the first sump volume and selectively accessible by the engine oil circulation system and a contained portion, substantially retained in the sump and contained within the second sump volume, the porous separator having a permeability to oil which increases with increasing oil temperature, the porous separator being shaped to receive oil returning to the sump container from the oil circulation path and to further contain the oil pickup for delivery of oil to the oil circulation path, the contained portion being external to the circulating portion and enclosed between the separator and the sump side-walls and bottom;

repeatedly circulating the circulating oil portion through the engine and raising its temperature;

the pores and thickness of the separator cooperating to initially limit mixing of the circulating and contained oil portions to control the heat loss from the circulating oil portion to the contained oil portion until the contained oil portion attains a target temperature, less than the operating temperature; and then, the separator gradually promoting mixing of the circulating and contained oil portions by progressively reversing the partitioning of the oil volume to enable the entire oil volume to be accessible to the oil circulation system and capable of circulation through the engine when the contained volume attains its operating temperature.

2. The method of heating a volume of oil contained in an internal combustion engine recited in claim 1 in which partitioning is reversed by selecting a separator which is substantially permeable to oil at the operating temperature of the oil.

3. The method of heating a volume of oil contained in an internal combustion engine recited in claim 1 in which the initial reduced temperature is substantially ambient temperature.

4. The method of heating a volume of oil contained in an internal combustion engine recited in claim 1 in which the oil operating temperature is about 90° C. or greater.

5. The method of heating a volume of oil contained in an internal combustion engine recited in claim 1 in which the target temperature is about 60° C.

6. A multi-cylinder, reciprocating piston, internal combustion engine, the engine comprising moving parts, in addition to the piston in each cylinder, and further comprising an oil circulation system, operative during engine operation, for delivering oil from a specified stored volume of oil in a lubrication oil sump container below the pistons and moving parts of the engine, in an oil circulation path for lubrication of the moving parts of the engine with the oil, the circulating oil returning to the lubrication oil sump container;

the lubrication oil sump container being shaped with side-walls and a bottom, to define space for the storage of a specified volume of lubrication oil, the volume of oil in the sump container being subject to ambient temperatures when the engine is not operating and progressively heated by engine operation to substantially stable temperatures of above about 90° C. during engine operation, the specified volume of lubrication oil being larger than the amount of oil continually drawn from the specified oil volume and delivered through the oil circulation path during engine operation, the sump container comprising an oil pick-up through which oil is delivered into the oil circulation path during engine operation and an upper opening for the return of oil from the oil circulation path;

the sump container further comprising a thin-walled perforated sheet porous separator comprising a plurality of openings with a characteristic dimension of between about 100 and 300 micrometers, the thin-walled perforated sheet porous separator having a thickness which is 2 to 3 times the characteristic dimension, the thin-walled perforated sheet porous separator having generally vertical upstanding walls extending from the sump bottom and having outwardly extending upper walls extending from the upstanding walls to the sump sidewalls, the separator serving to partition the sump volume into a first sump volume at least partially contained within the upstanding walls of the separator and an second sump volume contained between the upstanding and upper walls of the separator and the side-walls of the sump;

the walls of the porous separator having a plurality of openings, generally uniformly distributed, each of which openings is permeable to oil flow at temperatures of about 60° C. but resists the flow of cold oil through the separator during an engine cold start, so that, upon an engine cold start, the separator serves to initially separate the unheated oil within the sump container into two oil volumes, a circulating oil volume contained within the first sump volume and an enclosed oil volume contained within the second sump volume;

the circulating oil volume containing an at least like volume of oil to that oil being used in the oil circulation path, the circulating oil volume receiving engine-heated oil returning to the sump container from the oil circulation path, the oil pick-up being immersed in the circulating oil volume for delivery of oil to the oil circulation path;

the separator providing resistance to the infiltration of oil from the enclosed volume into the circulating volume until, by conduction and/or convection through the separator, the enclosed oil volume is heated sufficiently by the returning engine-heated oil that the enclosed oil permeates the separator and mixes with the circulating oil volume, enabling the entirety of the specified volume of sump lubricating oil to circulate through the oil circulation system of the engine.

7. The engine recited in claim 6 in which the separator provides minimal resistance to oil flow when the engine oil attains its operating temperature.

8. The engine recited in claim 6 in which the volume of circulating exterior oil is at least about one and one-half quarts.

9. The engine recited in claim 6 in which the ratio of circulating exterior oil to the total oil volume is about 25 to 30%.

10. A multi-cylinder, reciprocating piston, internal combustion engine, the engine comprising moving parts, in addition to the piston in each cylinder, and further comprising an oil circulation system, operative during engine operation, for delivering oil from a specified stored volume of oil in a lubrication oil sump container below the pistons and moving parts of the engine, in an oil circulation path for lubrication of the moving parts of the engine with the oil, the circulating oil returning to the lubrication oil sump container;

the lubrication oil sump container being shaped with side-walls and a bottom, to define space for the storage of a specified volume of lubrication oil, the volume of oil in the sump container being subject to ambient temperatures when the engine is not operating and progressively heated by engine operation to substantially stable temperatures of above about 90° C. during engine operation, the specified volume of lubrication oil being larger than the amount of oil continually drawn from the specified oil volume and delivered through the oil circulation path during engine operation, the sump container comprising an oil pick-up through which oil is delivered into the oil circulation path during engine operation and an upper opening for the return of oil from the oil circulation path;

the sump container further comprising a thin-walled porous separator comprising a small woven mesh member less than about a millimeter in thickness, wherein the thin-walled porous separator comprises a plurality of openings with a characteristic dimension of between about 100 and 300 micrometers and has a thickness which is 2 to 3 times the characteristic dimension, the thin-walled porous separator having generally vertical upstanding walls extending from the sump bottom and having outwardly extending upper walls extending from the upstanding walls to the sump sidewalls, the separator serving to partition the sump volume into a first sump volume at least partially contained within the upstanding walls of the separator and an second sump volume contained between the upstanding and upper walls of the separator and the side-walls of the sump;

the walls of the porous separator having a plurality of openings, generally uniformly distributed, each of which openings is permeable to oil flow at temperatures of about 60° C. but resists the flow of cold oil through the separator during an engine cold start, so that, upon an engine cold start, the separator serves to initially separate the unheated oil within the sump container into two oil volumes, a circulating oil volume contained within the first sump volume and an enclosed oil volume contained within the second sump volume;

the circulating oil volume containing an at least like volume of oil to that oil being used in the oil circulation path, the circulating oil volume receiving engine-heated oil returning to the sump container from the oil circulation path, the oil pick-up being immersed in the circulating oil volume for delivery of oil to the oil circulation path;

the separator providing resistance to the infiltration of oil from the enclosed volume into the circulating volume until, by conduction and/or convection through the separator, the enclosed oil volume is heated sufficiently by the returning engine-heated oil that the enclosed oil permeates the separator and mixes with the circulating oil volume, enabling the entirety of the specified volume of sump lubricating oil to circulate through the oil circulation system of the engine.

11. The engine recited in claim 10 in which the separator provides minimal resistance to oil flow when the engine oil attains its operating temperature.

12. The engine recited in claim 10 in which the volume of circulating exterior oil is at least about one and one-half quarts.

13. The engine recited in claim 10 in which the ratio of circulating exterior oil to the total oil volume is about 25 to 30%.

* * * * *